US009145536B2

(12) United States Patent
Adamy

(10) Patent No.: US 9,145,536 B2
(45) Date of Patent: Sep. 29, 2015

(54) PEROXIDE-CONTAINING CLEANING COMPOSITION WITH ENHANCED PEROXIDE STABILITY

(71) Applicant: CHURCH & DWIGHT CO., INC., Princeton, NJ (US)

(72) Inventor: Steven T. Adamy, Lawrenceville, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 4 days.

(21) Appl. No.: 14/135,864

(22) Filed: Dec. 20, 2013

(65) Prior Publication Data

US 2015/0175941 A1 Jun. 25, 2015

(51) Int. Cl.

| | |
|---|---|
| ***C11D 1/29*** | (2006.01) |
| ***C11D 1/72*** | (2006.01) |
| ***C11D 1/75*** | (2006.01) |
| ***C11D 3/26*** | (2006.01) |
| ***C11D 3/395*** | (2006.01) |
| ***C11D 3/39*** | (2006.01) |
| ***C11D 3/10*** | (2006.01) |
| ***C11D 1/00*** | (2006.01) |
| ***C11D 3/16*** | (2006.01) |
| ***C11D 3/30*** | (2006.01) |

(52) U.S. Cl.

CPC ..... *C11D 3/394* (2013.01); *C11D 1/00* (2013.01); *C11D 1/29* (2013.01); *C11D 1/72* (2013.01); *C11D 1/75* (2013.01); *C11D 3/10* (2013.01); *C11D 3/162* (2013.01); *C11D 3/30* (2013.01); *C11D 3/3942* (2013.01); *C11D 3/3947* (2013.01)

(58) Field of Classification Search

CPC ..... C11D 1/00; C11D 3/10; C11D 3/162; C11D 3/30; C11D 3/394; C11D 3/3942; C11D 3/3947

USPC ..... 510/303, 309, 336, 337, 372, 466, 504

See application file for complete search history.

(56) References Cited

U.S. PATENT DOCUMENTS

| | | | | |
|---|---|---|---|---|
| 6,010,993 | A * | 1/2000 | Romano et al. | 510/309 |
| 6,992,053 | B2 * | 1/2006 | Cermenati et al. | 510/238 |
| 6,994,890 | B2 * | 2/2006 | Ohlhausen et al. | 427/393.4 |
| 7,589,054 | B2 * | 9/2009 | Ohlhausen et al. | 510/504 |

(Continued)

FOREIGN PATENT DOCUMENTS

| | | |
|---|---|---|
| JP | 7216397 | 1/1994 |
| JP | 2002356313 A | 12/2002 |

(Continued)

OTHER PUBLICATIONS

American Chemical Society, Reagent Chemicals, Sixth Ed., American Chemical Society, Washington, D.C., pp. 287-288, 1981.

(Continued)

*Primary Examiner* — Gregory R Delcotto

(74) *Attorney, Agent, or Firm* — Fishman & Associates, LLC

(57) ABSTRACT

A peroxide-containing cleaning composition with enhanced peroxide stability includes a peroxide-containing bleaching agent, at least one surfactant, an alkali metal salt in amounts sufficient to maintain an alkaline pH, a silane quaternary ammonium compound present in an amount sufficient to enhance the stability of the peroxide-containing bleaching agent, and an aqueous diluent. A method of stabilizing a peroxide-containing cleaning composition is also disclosed.

5 Claims, 1 Drawing Sheet

(56) References Cited

U.S. PATENT DOCUMENTS

| | | | | |
|---|---|---|---|---|
| 7,704,313 | B2 | 4/2010 | Ohlhausen et al. | |
| 2005/0096250 | A1* | 5/2005 | Ohlhausen et al. | 510/504 |
| 2006/0110348 | A1* | 5/2006 | Ohlhausen et al. | 424/70.1 |
| 2007/0065475 | A1* | 3/2007 | Elfersy | 424/405 |
| 2008/0000032 | A1* | 1/2008 | Wieprecht et al. | 8/111 |
| 2008/0161219 | A1* | 7/2008 | Ohlhausen et al. | 510/369 |
| 2008/0175801 | A1 | 7/2008 | Ramji | |
| 2008/0274932 | A1* | 11/2008 | Smith et al. | 510/225 |
| 2009/0246165 | A1* | 10/2009 | Toreki et al. | 424/78.07 |
| 2011/0021399 | A1* | 1/2011 | Smith et al. | 510/161 |
| 2012/0125226 | A1* | 5/2012 | Ohlhausen et al. | 106/2 |
| 2012/0129755 | A1* | 5/2012 | Zhu et al. | 510/372 |
| 2012/0289447 | A1* | 11/2012 | Adamy | 510/304 |

FOREIGN PATENT DOCUMENTS

| | | | |
|---|---|---|---|
| JP | 2007106903 | A | 4/2007 |
| KR | 20050004309 | A | 1/2005 |
| KR | 20050005676 | A | 1/2005 |

OTHER PUBLICATIONS

James et al. "The Chemistry of Peroxide Bleaching." Chemistry & Industry, Part 20. pp. 641-645, Oct. 15, 1990.

Ilkay Kiran , Nihal Bekta§ , H. Cengiz Yatmaz & Mesut Tekba § (2013): Photocatalytic Fenton oxidation of sodium dodecyl sulfate solution using iron-modified zeolite catalyst, Desalination and Water Treatment, DOI:10.1080/19443994.2012.759517.

Lin et al. "Singlet oxygen generated from the decomposition of peroxymonocarbonate and its observation with chemiluminesence method." Spectrochimica Acta Part A 72 (2009): 126-132. Web. Aug. 26, 2008.

Meledje et al. "Kinetic Study of Catalytic Oxidation of Sodium Dodecylsulphate by Fenton's Reagent in Aqueous Solution." Australian Journal of Basic and Applied Sciences, 4(6): 1203-1214. 2010.

Regino et al. "Bicarbonate-Catalyzed Hydrogen Peroxide Oxidation of Cysteine and Related Thiols." Inorganica Chimica Acta 360 (2007) 3971-3977. Web. May 24, 2007.

Richardson et al. "Equilibria Kinetics and Mechanism in the Bicarbonate Activation of Hydrogen Peroxide: Oxidation of Sulfides by Peroxymonocarbonate." Journal of American Chemical Society 2000, 122, 1729-1739. Web. Feb. 10, 2000.

Schumb et al. "Hydrogen Peroxide." American Chemical Society. New York, NY. pp. 526-527. 1955.

* cited by examiner

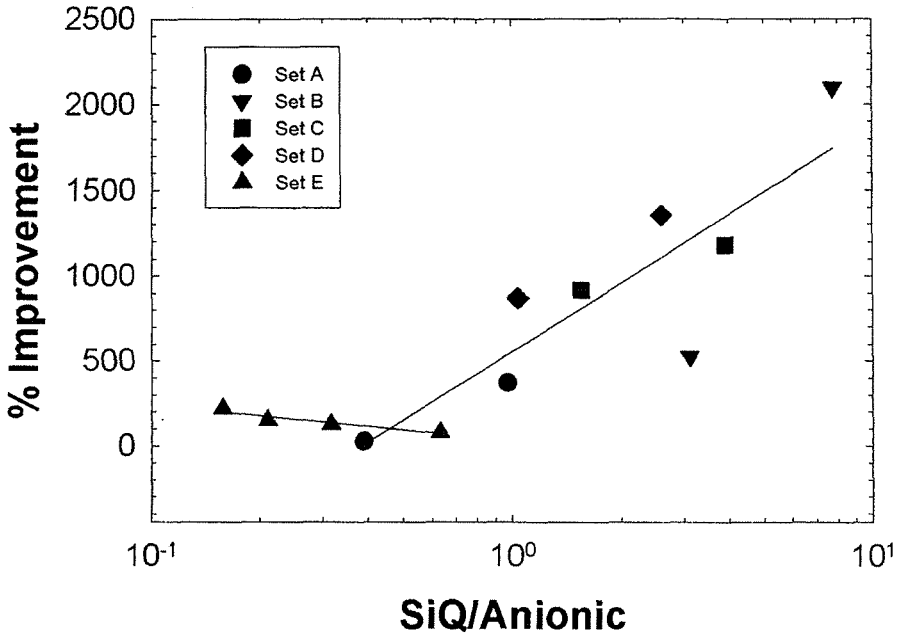
2500
2000
1500
1000
500
0
% Improvement
Set A
Set B
Set C
Set D
Set E
$10^{-1}$
$10^{0}$
$10^{1}$
SiQ/Anionic

PEROXIDE-CONTAINING CLEANING COMPOSITION WITH ENHANCED PEROXIDE STABILITY

FIELD OF THE INVENTION

The present invention relates to peroxide-containing compositions, and more particularly to peroxide-containing cleaning compositions exhibiting enhanced peroxide stability.

BACKGROUND OF THE INVENTION

Peroxides such as hydrogen peroxide have a bleaching effect on organic substances and are therefore used in, for example, detergents, cleaning compositions, disinfectants, deodorizers and hair coloring products. Peroxide-based solutions are well-known for their oxidative and antimicrobial properties, and have been used in washing and cleaning processes. Generally, to clean a substrate such as clothing, the substrate is subjected to hydrogen peroxide or a substance capable of generating perhydroxyl ions ($HOO^-$), such as inorganic or organic peroxides. Upon contact with the surface of the soiled substrate, the peroxide effectively removes common stains such as coffee or wine, while disinfecting the cleaned surface.

To be effective, peroxide-containing solutions must contain a sufficient amount of peroxide to both clean and disinfect. Accordingly, it is desirable to add ingredients and employ conditions which maximize the activity of peroxides. However, peroxide compounds are very labile. The amount of peroxide in cleaning compositions typically decreases as a function of time under normal storage conditions. Ingredients and conditions which favor maximizing the activity of peroxides, likewise, reduce the stability of peroxides under storage conditions. This creates a problem with efficacy.

Accordingly, it would be useful to formulate a peroxide-containing cleaning composition exhibiting enhanced peroxides while improving the stability of the peroxides under storage conditions. There is a need for a peroxide-containing cleaning composition exhibiting both enhanced activity and improved peroxide stability.

SUMMARY OF THE INVENTION

The present invention relates generally to a peroxide-containing cleaning composition exhibiting improved peroxide stability with extended shelf-life. The peroxide-containing cleaning composition of the present invention is specifically formulated for enhanced cleaning (bleaching) activity, while substantially improving peroxide stability. The peroxide-containing cleaning composition of the present invention can be used in a range of cleaning products including, but not limited to, laundry detergents, carpet/rug cleaners, glass cleaning products, dish washing compositions, hard surface cleaners, and scouring agents. The present peroxide-containing cleaning composition includes a peroxide-containing bleaching agent for supplying reactive oxygen species in amounts sufficient to perform cleaning (bleaching), at least one surfactant for enhancing detersive and cleaning action, an alkali metal salt in amounts sufficient to maintain an alkaline pH of the composition where an alkaline pH is known to enhance peroxide activity, and an aqueous diluent. Of particular importance to the present invention is the addition of a silane quaternary ammonium compound which interacts with the components of the composition to improve peroxide stability. As used herein, the term "peroxide-containing bleaching agent" means an agent that contains and/or liberates the peroxide ion.

In one aspect of the present invention, there is provided a cleaning composition, which comprises:

a peroxide-containing bleaching agent;

at least one surfactant;

an alkali metal salt in amounts sufficient to maintain an alkaline pH of the composition;

a silane quaternary ammonium compound present in an amount sufficient to enhance the stability of the peroxide-containing bleaching agent; and an aqueous diluent.

In another aspect of the present invention, the mole ratio between the silane quaternary ammonium compound and the surfactant, especially an anionic surfactant, controls the stability of the peroxide.

In another aspect of the present invention, there is provided a method of stabilizing a peroxide-containing cleaning composition containing a peroxide-containing bleaching agent especially at an alkaline pH, which comprises adding at least one surfactant and a silane quaternary ammonium compound in amounts sufficient to enhance the stability of the peroxide-containing bleaching agent.

BRIEF DESCRIPTION OF THE DRAWINGS

The following drawing is illustrative of preferred embodiments of the present invention, which are not intended to limit the invention as encompassed by the claims forming part of the application.

FIG. 1 is a graph plotting data corresponding to % improvement in peroxide stability as correlated with the mole ratio of silane quaternary ammonium compound to anionic surfactant in accordance with the present invention.

DETAILED DESCRIPTION OF THE INVENTION

The present invention is directed to a peroxide-containing cleaning composition with enhanced peroxide activity and which exhibits improved peroxide stability to promote extended shelf-life. The peroxide-containing cleaning composition of the present invention is specifically formulated for enhancing cleaning (bleaching) activity, while substantially improving peroxide stability. The peroxide-containing cleaning composition of the present invention can be used in a range of cleaning products including, but not limited to, laundry detergents, carpet/rug cleaners, glass cleaning products, dishwashing compositions, hard surface cleaners, and scouring agents.

It is desirable to formulate peroxide-containing compositions at alkaline pH levels to improve peroxide activity as compared with compositions at lower pH levels. Maintaining alkaline pH levels typically requires buffers such as alkali metal salts. It is difficult to maintain peroxide stability in liquid systems at alkaline pH levels (8 and up) especially in the presence of alkali metal salt buffers such as sodium bicarbonate, and surfactants such as alkyl ethoxy sulfates. It is believed that the reason liquid systems do not maintain desired peroxide levels, especially at alkaline pH levels, is, that in solution, the peroxide molecule exhibits a strong tendency to undergo deprotonation forming perhydroxyl ion ($HOO^-$):

$$H_2O_2 \leftrightharpoons HOO^- + H^+ (pKa=11.6) \quad [1]$$

Because peroxide is more active at alkaline pH levels, it is also more unstable. The decomposition of peroxide is especially enhanced by the presence of metal ions, for example, ferric ion:

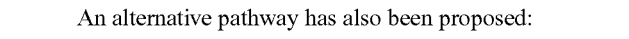

$$Fe^{3+}+HOO^{-}\rightarrow Fe^{2+}+HOO. \quad [2]$$

The perhydroxyl radical (HOO.) can further react with $Fe^{3+}$:

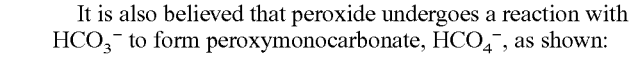

$$Fe^{3+}+HOO.\rightarrow Fe^{2+}+H^{+}+O_2 \quad [3]$$

An alternative pathway has also been proposed:

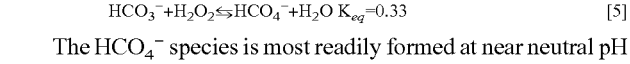

$$H_2O_2+HOO.\rightarrow HO.+H_2O+O_2 \quad [4]$$

It is also believed that peroxide undergoes a reaction with $HCO_3^{-}$ to form peroxymonocarbonate, $HCO_4^{-}$, as shown:

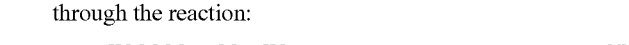

$$HCO_3^{-}+H_2O_2\leftrightarrows HCO_4^{-}+H_2O \; K_{eq}=0.33 \quad [5]$$

The $HCO_4^{-}$ species is most readily formed at near neutral pH and is a powerful oxidant, where it undergoes decomposition through the reaction:

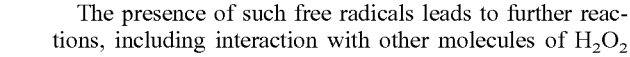

$$HOOCOO^{-}\rightarrow CO_3.+HO. \quad [6]$$

The presence of such free radicals leads to further reactions, including interaction with other molecules of $H_2O_2$ forming singlet oxygen species as shown in the following series of reactions:

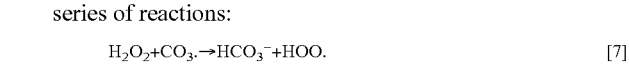

$$H_2O_2+CO_3.\rightarrow HCO_3^{-}+HOO. \quad [7]$$

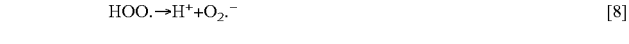

$$HOO.\rightarrow H^{+}+O_2.^{-} \quad [8]$$

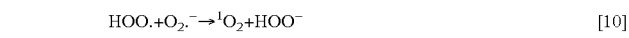

$$O^{2}.^{-}+HO.\rightarrow {}^{1}O_2+HO^{-} \quad [9]$$

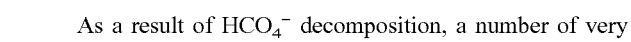

$$HOO.+O_2.^{-}\rightarrow {}^{1}O_2+HOO^{-} \quad [10]$$

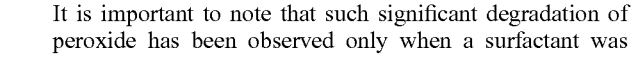

$$HOO.+HOO.\rightarrow {}^{1}O_2+H_2O_2 \quad [11]$$

As a result of $HCO_4^{-}$ decomposition, a number of very reactive species can form including superoxide anions ($O_2.^{-}$). It is important to note that such significant degradation of peroxide has been observed only when a surfactant was present. It is believed that the presence of the surfactant may accelerate the above series of reactions through consumption of the oxidative species (i.e., from reaction of oxidants with the surfactant). Consumption of the oxidative species produced in reactions [7] through [11] is believed to force the equilibrium of reaction [5] to the right, therefore consuming $H_2O_2$.

Accordingly, a peroxide-containing cleaning composition can achieve enhanced peroxide activity by the inclusion of at least one surfactant and providing an alkaline environment through the use of alkaline buffers such as alkali metal salts. However, enhanced peroxide activity correlates with reduced peroxide stability (shorter shelf-life for the cleaning composition).

The present invention addresses this problem through the addition of a silane quaternary ammonium compound and controlling the mole ratio of the compound the surfactant(s) employed in the composition, especially anionic surfactants.

The present invention is directed to a peroxide-containing cleaning composition operable at peroxide activity enhancing alkaline pH levels which exhibit improved shelf-lives. In one embodiment of the present invention, the present peroxide-containing cleaning composition includes a peroxide-containing bleaching agent for supplying reactive oxygen species in amounts sufficient to perform oxidative cleaning (bleaching), at least one surfactant for enhancing detersive and cleaning action, an alkali metal salt in amounts sufficient to maintain an alkaline pH of the composition where an alkaline pH is known to enhance peroxide activity, and an aqueous diluent. Of particular importance to the present invention is the addition of a silane quaternary ammonium compound which interacts with the components of the composition to improve peroxide stability.

In a preferred embodiment of the present invention, the composition contains an anionic surfactant and the mole ratio of the silane quaternary ammonium compound to the anionic surfactants is at least about 0.4.

The present peroxide-containing cleaning compositions are formulated for operation and storage at pH levels of at least 8, preferably from about 8 to 12 and more preferably from about 8 to 10. It has been found advantageous that peroxide-containing cleaning compositions formulated at alkaline pH: 1) maintain a higher fraction of peroxide in the active bleaching form ($HOO^{-}$) for greater efficacy, and 2) minimize reductions in pH when the present peroxide-containing cleaning composition is added to a wash already containing a detergent with an alkaline pH. This can be achieved by incorporating an alkaline pH modifying agent suitable for raising pH levels of the peroxide-containing cleaning composition. The alkaline pH modifying agent may be selected, for example, from alkali metal hydroxides such as sodium hydroxide, carbonates such as sodium carbonate, sesquicarbonates, borates, silicates, phosphates, and the like. Such alkaline pH modifying agents are present in a total amount effective to provide the present peroxide-containing cleaning composition in the desired pH range as mentioned above.

An alkaline buffer for maintaining the pH in the desired pH range as mentioned above is used in the present compositions. The alkaline buffer functions to impart to the present composition the capacity to resist changes in alkaline pH level. Suitable alkaline buffers may be selected, for example, from an alkali metal salt such as sodium and potassium bicarbonates. The alkaline buffer (e.g., bicarbonate salt) is generally added in amounts of up to about 10 wt % based on the total weight of the composition, preferably from about 0.1 wt % to 2.5 wt %, and more preferably from about 0.25 wt % to 1.0 wt %.

The peroxide-containing bleaching agent of the present peroxide-containing cleaning composition may be selected from hydrogen peroxide, a compound capable of liberating hydrogen peroxide, a peroxyacid, a peroxyacid bleach precursor or combinations thereof. A preferred peroxide-containing bleaching agent is hydrogen peroxide. Hydrogen peroxide is typically employed as a concentrated aqueous solution, such as Arkema® peroxide CG 50-HP or Akzo PB33.

Compounds which liberate hydrogen peroxide include, but are not limited to, inorganic compounds such as peroxides, perborates, percarbonates, perphosphates and persulfates, and organic compounds such as peroxylauric acid, peroxybenzoic acid, 1,12-diperoxydodecanoic acid, diperoxyisophthalic acid and urea peroxide, and combinations thereof. Examples further include sodium percarbonate and sodium perborate (e.g., sodium perborate monohydrate).

Peroxyacid compounds and peroxyacid bleach precursors include, for example, those selected from compounds described in U.S. Pat. No. 5,114,606, which is incorporated by reference herein in its entirety.

Particular examples of peroxide-containing bleaching agents employed for the present invention include those classified broadly as oxygen bleaches. The oxygen bleaches are represented by percompounds which are true persalts or compounds which liberate hydrogen peroxide in solution. Examples include sodium and potassium perphosphates, perborates, percarbonates, and monopersulfates.

The preferred amounts of the peroxide-containing bleaching agent are up to 12 wt % based on the total weight of the composition, preferably from about 0.2 wt % to 6.0 wt %, and more preferably from about 0.1 wt % to 2.0 wt %. It is understood that the peroxide-containing compounds described above would be used at levels that could generate these amounts, so long as the use of such amounts is possible without promoting formulation incompatibility.

The surfactant of the present peroxide-containing cleaning composition may be selected from anionic surfactants, nonionic surfactants, amphoteric surfactants, and combinations thereof. It is preferred that the cleaning composition containing an anionic surfactant. The surfactant may include mixtures of two or more types of surfactants formulated into the peroxide-containing cleaning composition of the present invention, especially combinations of surfactants containing at least one anionic surfactant.

Suitable anionic surfactants include those selected, for example, from alkyl ethoxy sulfates, alkyl sulfates, alkyl sulfonates, alkybenzyl sulfonates, branched alkyl sulfates, branched alkyl sulfonates, alkyl sulfosuccinates, diphenyloxide sulfonates, N-methyl taurates, alkyl isethionates, alkyl phosphate esters, and combinations thereof. Preferred alkyl ethoxy sulfates may be selected from sodium laureth-30-sulfate, sodium trideceth-3-sulfate, sodium laureth-12-sulfates and combinations thereof.

Suitable nonionic surfactants may be selected from ethoxylated fatty alcohols, propoxylated fatty alcohols, alkanol amides, ethoxylated alkanol amides, alkylphenol ethoxylates, and combinations thereof. Preferred ethoxylated fatty alcohols may be selected from C12-C15 ethoxylated fatty alcohols, and combinations thereof.

Suitable amphoteric surfactants may be selected from alkyl dimethyl amine oxides, alkyl betaines, alkyl amidopropyl betaines, alkyl ether hydroxypropyl sultaines, alkyl amidopropyl hydroxy sultaines, and combinations thereof. Preferred alkyl dimethyl amine oxides are selected from the group consisting of lauryl amine oxide, decyl amine oxide, and combinations thereof.

In the present invention, the amount of the surfactants in the present peroxide-containing cleaning compositions may be up to about 15 wt % based on the total weight of the composition, preferably from about 1.5 wt % to 12.0 wt %, and more preferably from about 3.0 wt % to 7.5 wt %.

In a preferred formulation, an anionic surfactant is used in an amount sufficient to provide a mole ratio of the silane quaternary ammonium compound to the anionic surfactant of at least 0.4, preferably from about 0.4 to 3.5.

The silane quaternary ammonium compound of the present peroxide-containing cleaning composition includes those which may be represented by the following structural representation:

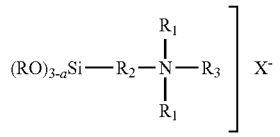

wherein:

R is independently selected from a $C_1$-$C_{10}$ alkyl group, or hydrogen, and a is 0, 1, or 2;

$R_1$ and $R_2$ are each independently selected from a $C_1$-$C_{10}$ alkyl group, or a $C_1$-$C_{10}$ alkenyl group; and $R_3$ is selected from a $C_{11}$-$C_{22}$ alkyl group; and X represents a salt-forming counterion.

In preferred embodiment of the present invention, R is independently selected from a $C_1$-$C_4$ group, and $R_1$ and $R_2$ are each independently selected from a $C_1$-$C_8$ alkyl group, or a $C_1$-$C_8$ alkenyl group. Preferred salt-forming counterion for X is selected from halides and more preferably, chloride and bromide.

In a more preferred embodiment of the present invention, R and $R_1$ are each selected from methyl and ethyl, $R_2$ is selected from straight chain links of methylene groups consisting of from 1 to 4 members, and $R_3$ is selected from straight chain links of methylene groups consisting of from 11 to 22 members. More preferably, both $R_1$ groups are methyl.

A particularly useful silane quaternary ammonium compound useful in the present peroxide-containing cleaning composition is AEM® 5772 or AEM® 5700 (from Aegis Environmental Company of Midland, Mich. now part of Microban of Huntersville, N.C.). Both of these materials are described as being 3-(trimethoxysilyl)propyloctadecyldimethylammonium chloride. AEM® 5700 is sold as a 42% by weight active solution of the compound in methanol, while AEM® 5772 is sold as a 72% by weight active solution of the compound in methanol. Other useful quaternary ammonium organosilanes of the present invention are 3-(trimethoxysilyl) propyldimethyloctadecyl ammonium chloride and 3-(trimethoxysilyl)propyldidecylmethyl ammonium chloride.

The silane quaternary ammonium compounds are desirably used in the present peroxide-containing cleaning composition in amounts of up to 5.0 wt % based on the total weight of the composition, preferably in amounts of from 0.1 wt % to 5.0 wt %, and most preferably from 0.3 wt % to 5.0 wt %. In a preferred embodiment of the present invention, where the present peroxide-containing cleaning composition includes an anionic surfactant, the amount of silane quaternary ammonium compound is preferably in the upper end of the range (e.g., 2.0 wt % to 5.0 wt % of silane quaternary ammonium compound).

It is noted that the present compositions may contain a small amount of an organic solvent for the silane quaternary ammonium compounds. As previously noted, the silane quaternary ammonium compounds are marketed in a solvent such as methanol. While methanol is a preferred solvent, other lower alcohols, $C_1$ to $C_4$, can be used. The solvent will be present in amounts of about 10 wt % to 50 wt % of the silane quaternary ammonium compound.

In another preferred embodiment of the present invention, the relative weight ratio of silane quaternary ammonium compound to surfactant will range from about 0.2:1 to 4:1, and more preferably from about 1:1 to 2:1.

In another embodiment of the present invention, there is provided a method of stabilizing a peroxide-containing cleaning composition having a peroxide-containing bleaching agent especially at an alkaline pH comprising adding at least one surfactant and silane quaternary ammonium compound in amounts sufficient to enhance the stability of the peroxide-containing bleaching agent.

EXAMPLES

Example 1

A peroxide-containing cleaning composition according to the present invention was prepared in Table 1 as follows:

TABLE 1

| Ingredients | % by weight |
|---|---|
| $H_2O_2$ (Arkema ® CG50HP) | 2.0 |
| Silane Quaternary Ammonium Compound (Microban AEM ® 5772) | 2.0 |
| C12-15, 7EO ethoxylated alcohol (Shell ® Neodol ® 25-7) | 5.625 |
| Decyl amine oxide (Stepan ® Ammonyx ® DO) | 5.625 |
| Sodium laureth-30-sulfate (Stepan ® Polystep ® B19) | 3.75 |
| Sodium bicarbonate (0.1M) | 81.0 |
| Water | Q.S. |

The peroxide-containing cleaning composition was prepared by combining the ingredients and mixing well to form an aqueous solution.

Example 2

Various formulations of the present peroxide-containing cleaning composition containing octadecylaminodimethyltrimethoxysilylpropyl ammonium chloride were tested at pH between 8 and 9 to determine peroxide stability.

The data are presented in separate sets A-D which represent similar compositions. The following materials listed in Table 2 were used:

TABLE 2

| Material | Supplier | Description |
|---|---|---|
| Polystep ® B19 | Stepan ® | Sodium laureth-30-sulfate (AES30) |
| Neodol ® 25-7 | Shell ® | C12-C15 ethoxylated fatty alcohol 7EO (25-7) |
| Ammonyx ® LO | Stepan ® | Lauryl amine oxide (C12AO) |
| Ammonyx ® DO | Stepan ® | Decyl amine oxide (C10AO) |
| CG50 HP | Arkema ® | $H_2O_2$, 50% solution in water |

The silane quaternary ammonium compound used was AEM® 5772 (from Microban, formerly manufactured by Aegis). The composition of AEM® 5772 is shown in Table 3 below:

TABLE 3

| Components | Wt. % |
|---|---|
| Methyl alcohol | 12 |
| Octadecylaminodimethyltrimethoxysilylpropyl ammonium chloride | 72 |
| Chloropropyltrimethoxysilane | 15 |
| Dimethyl octadecylamine | 1 |

All formulations shown below are in terms of weight %, on an actives basis.

Set A:

TABLE 4

| Formulation | Sample 3815-6- | AES30 | C12AO | 25-7 | AEM ® 5772 | $H_2O_2$ | 0.1M $NaHCO_3$ (aq) |
|---|---|---|---|---|---|---|---|
| 1 | 12 | 12 | 1.5 | 1.5 | | 2 | 83 |
| 2 | 1 | 12 | 1.5 | 1.5 | 2 | 2 | 81 |
| 3 | 6 | 12 | 1.5 | 1.5 | 5 | 2 | 78 |

Following the incubation period of 74 days at room temperature (about 23° C.), the following pH and peroxide levels were obtained in Table 5 below.

TABLE 5

| Formulation | Sample 3815-6- | Initial % $H_2O_2$ | Initial % ± | % $H_2O_2$ 74 days | 74 days % ± | % remaining $H_2O_2$ at 74 days | 74 days % remaining ± |
|---|---|---|---|---|---|---|---|
| 1 | 12 | 0.942 | 0.0243 | 0.080 | 0.0145 | 8.48 | 0.22 |
| 2 | 1 | 1.505 | 0.0093 | 0.162 | 0.0174 | 10.73 | 0.07 |
| 3 | 6 | 1.343 | 0.0239 | 0.539 | 0.0053 | 40.11 | 0.71 |

Values of pH were alkaline in each of Formulations 1-3. The corresponding pH values were recorded below in Table 6:

TABLE 6

| Formulation | Sample 3815-6- | Initial pH | pH 74 days |
|---|---|---|---|
| 1 | 12 | 8.9 | 9.5 |
| 2 | 1 | 8.8 | 9.1 |
| 3 | 6 | 8.0 | 8.4 |

Increasing the level of silane quaternary ammonium compound increased peroxide stability. Formulation 3, with 5% AEM 5772 maintained a level of peroxide five times that of Formulation 1, having no AEM 5772.

Set B:

TABLE 7

| Formulation | Sample 3815-6- | AES30 | C12AO | 25-7 | AEM ® 5772 | $H_2O_2$ | 0.1M $NaHCO_3$ (aq) |
|---|---|---|---|---|---|---|---|
| 4 | 13 | 1.5 | 1.5 | 12 | | 2 | 83 |
| 5 | 2 | 1.5 | 1.5 | 12 | 2 | 2 | 81 |
| 6 | 7 | 1.5 | 1.5 | 12 | 5 | 2 | 78 |

Following the incubation period of 74 days at room temperature (about 23° C.), the following pH and peroxide levels were obtained for Formulations 4-5 in Table 8.

TABLE 8

| Formulation | Sample 3815-6- | Initial % $H_2O_2$ | Initial % ± | % $H_2O_2$ 74 days | 74 days % ± | % remaining $H_2O_2$ at 74 days | 74 days % remaining ± |
|---|---|---|---|---|---|---|---|
| 4 | 13 | 1.702 | 0.0302 | 0.050 | 0.0183 | 2.92 | 0.05 |
| 5 | 2 | 1.893 | 0.0036 | 0.346 | 0.0064 | 18.30 | 0.04 |
| 6 | 7 | 1.799 | 0.0010 | 1.155 | 0.0006 | 64.22 | 0.03 |

Values of pH were alkaline in each of Formulations 4-6. The corresponding pH values were recorded below in Table 9.

TABLE 9

| Formulation | Sample 3815-6- | Initial pH | pH 74 days |
|---|---|---|---|
| 4 | 13 | 8.9 | 9.7 |
| 5 | 2 | 8.8 | 9.7 |
| 6 | 7 | 7.5 | 8.4 |

Again, increasing the level of silane quaternary ammonium compound significantly improved peroxide stability.

Set C:

TABLE 10

| Formulation | Sample 3815-6- | AES30 | C12AO | 25-7 | AEM ® 5772 | $H_2O_2$ | 0.1M $NaHCO_3$ (aq) |
|---|---|---|---|---|---|---|---|
| 7 | 14 | 3 | 4.5 | 7.5 | | 2 | 83 |
| 8 | 3 | 3 | 4.5 | 7.5 | 2 | 2 | 81 |
| 9 | 8 | 3 | 4.5 | 7.5 | 5 | 2 | 78 |

Following the incubation period of 74 days at room temperature (about 23° C.), the following pH and peroxide levels were obtained for Formulations 7-9 in Table 11.

TABLE 11

| Formulation | Sample 3815-6- | Initial % $H_2O_2$ | Initial % ± | % $H_2O_2$ 74 days | 74 days % ± | % remaining $H_2O_2$ at 74 days | 74 days % remaining ± |
|---|---|---|---|---|---|---|---|
| 7 | 14 | 1.450 | 0.0335 | 0.064 | 0.0006 | 4.38 | 0.10 |
| 8 | 3 | 1.616 | 0.0160 | 0.720 | 0.0041 | 44.55 | 0.44 |
| 9 | 8 | 1.603 | 0.0028 | 0.898 | 0.0175 | 56.02 | 0.10 |

Values of pH were alkaline in each of Formulations 7-9. The corresponding pH values were recorded below in Table 12.

TABLE 12

| Formulation | Sample 3815-6- | Initial pH | pH 74 days |
|---|---|---|---|
| 7 | 14 | 8.8 | 9.6 |
| 8 | 3 | 8.6 | 7.7 |
| 9 | 8 | 7.7 | 9.5 |

Set D:

TABLE 13

| Formulation | Sample 3815-6- | AES30 | C12AO | 25-7 | AEM ® 5772 | $H_2O_2$ | 0.1M $NaHCO_3$ (aq) |
|---|---|---|---|---|---|---|---|
| 10 | 15 | 4.5 | 6 | 4.5 | | 2 | 83 |
| 11 | 4 | 4.5 | 6 | 4.5 | 2 | 2 | 81 |
| 12 | 9 | 4.5 | 6 | 4.5 | 5 | 2 | 78 |

Following the incubation period of 74 days at room temperature (about 23° C.), the following pH and peroxide levels were obtained for Formulations 10-12 in Table 14.

TABLE 14

| Formulation | Sample 3815-6- | Initial % $H_2O_2$ | Initial % ± | % $H_2O_2$ 74 days | 74 days % ± | % remaining $H_2O_2$ at 74 days | 74 days % remaining ± |
|---|---|---|---|---|---|---|---|
| 10 | 15 | 1.161 | 0.0060 | 0.048 | 0.0139 | 4.13 | 0.02 |
| 11 | 4 | 1.586 | 0.0194 | 0.636 | 0.0059 | 40.07 | 0.49 |
| 12 | 9 | 1.485 | 0.0516 | 0.891 | 0.0071 | 60.01 | 2.09 |

Values of pH were alkaline in each of Formulations 10-12. The corresponding pH values were recorded below in Table 15.

TABLE 15

| Formulation | Sample 3815-6- | Initial pH | pH 74 days |
|---|---|---|---|
| 10 | 15 | 8.9 | 9.8 |
| 11 | 4 | 8.6 | 9.3 |
| 12 | 9 | 7.8 | 9.6 |

Set E:

TABLE 16

| Formulation | Sample 4189-149- | $H_2O_2$ (From Arkema ® CG50HP) | Aegis AEM ® 5772 Silane Quaternary Ammonium Compound | Neodol ® 25-7 (C12-15, 7EO ethoxylated alcohol) | C10AO (from Stepan ® Ammonyx ® DO) | AES12 (from Stepan ® Polystep ® B23) | 0.1M NaHCO3 (aq) |
|---|---|---|---|---|---|---|---|
| 13 | 11 | 2.0 | 0 | 7.50 | 7.50 | 0 | 83.0 |
| 14 | 12 | 2.0 | 0 | 5.625 | 5.625 | 3.75 | 83.0 |
| 15 | 13 | 2.0 | 0 | 3.75 | 3.75 | 7.50 | 83.0 |
| 16 | 14 | 2.0 | 0 | 1.875 | 1.875 | 11.25 | 83.0 |
| 17 | 15 | 2.0 | 0 | 0 | 0 | 15.0 | 83.0 |
| 18 | 16 | 2.0 | 2.0 | 7.50 | 7.50 | 0 | 81.0 |
| 19 | 17 | 2.0 | 2.0 | 5.625 | 5.625 | 3.75 | 81.0 |
| 20 | 18 | 2.0 | 2.0 | 3.75 | 3.75 | 7.50 | 81.0 |
| 21 | 19 | 2.0 | 2.0 | 1.875 | 1.875 | 11.25 | 81.0 |
| 22 | 20 | 2.0 | 2.0 | 0 | 0 | 15.0 | 81.0 |

Formulations 13-22 were incubated at 50° C. and assessed at 2 weeks for peroxide and pH level. Results are shown in Tables 17 and 18, respectively, below:

TABLE 17

| | | t = 0 | | T = 14 days | |
|---|---|---|---|---|---|
| Formulation | Sample 4189-149- | % $H_2O_2$ | error | % $H_2O_2$ | Error |
| 13 | 11 | 2.05 | 0.010 | 1.54 | 0.0077 |
| 14 | 12 | 2.09 | 0.010 | 0.86 | 0.0043 |
| 15 | 13 | 2.02 | 0.010 | 0.63 | 0.0032 |
| 16 | 14 | 2.03 | 0.010 | 0.49 | 0.0025 |
| 17 | 15 | 2.06 | 0.010 | 0.19 | 0.0009 |
| 18 | 16 | 2.03 | 0.010 | 1.62 | 0.0081 |

TABLE 17-continued

| | | t = 0 | | T = 14 days | |
|---|---|---|---|---|---|
| Formulation | Sample 4189-149- | % $H_2O_2$ | error | % $H_2O_2$ | Error |
| 19 | 17 | 1.97 | 0.006 | 1.54 | 0.0077 |
| 20 | 18 | 2.03 | 0.010 | 1.44 | 0.0072 |
| 21 | 19 | 1.99 | 0.010 | 1.24 | 0.0062 |
| 22 | 20 | 2.05 | 0.010 | 0.61 | 0.0030 |

TABLE 18

| Formulation | Sample 4189-149- | pH at t = 0 | pH at t = 14 days |
|---|---|---|---|
| 13 | 11 | 8.11 | 8.96 |
| 14 | 12 | 8.08 | 9.03 |
| 15 | 13 | 8.08 | 8.73 |
| 16 | 14 | 8.15 | 7.45 |
| 17 | 15 | 8.20 | 4.76 |

TABLE 18-continued

| Formulation | Sample 4189-149- | pH at t = 0 | pH at t = 14 days |
|---|---|---|---|
| 18 | 16 | 8.03 | 8.6 |
| 19 | 17 | 8.05 | 8.13 |
| 20 | 18 | 8.03 | 8.22 |
| 21 | 19 | 8.06 | 8.47 |
| 22 | 20 | 8.15 | 8.05 |

In most cases, the pH remained alkaline over the incubation period. In Formulation 17, the pH dropped dramatically, but the level of peroxide also dramatically decreased.

Directly comparing corresponding formulas with and without a silane quaternary ammonium compound, the following results are observed in Table 19 below.

TABLE 19

| Formulation with no silane quaternary ammonium compound | Formulation with silane quaternary ammonium compound | % $H_2O_2$ remaining without silane quaternary ammonium compound | % $H_2O_2$ remaining without silane quaternary ammonium compound ± | % $H_2O_2$ remaining with silane quaternary ammonium compound | % $H_2O_2$ remaining without silane quaternary ammonium compound ± |
|---|---|---|---|---|---|
| 13 | 18 | 75.12 | 0.5 | 79.80 | 0.5 |
| 14 | 19 | 41.15 | 0.5 | 78.17 | 0.5 |
| 15 | 20 | 31.19 | 0.5 | 70.94 | 0.5 |
| 16 | 21 | 24.14 | 0.5 | 62.31 | 0.5 |
| 17 | 22 | 9.22 | 0.5 | 29.76 | 0.5 |

In all cases, addition of the silane quaternary ammonium compound improved peroxide stability. It was apparent, however, that the degree to which the silane quaternary ammonium compound was beneficial was dependent on the overall composition.

The results above show that inclusion of the silane quaternary ammonium compound generally improved peroxide stability for peroxide-containing compositions maintained at alkaline pH levels compared with systems not containing the silane quaternary ammonium compound. It was apparent that the extent to which the silane quaternary ammonium compound improved stability was dependent on the formulation.

In order to quantify the relative improvement in peroxide stability, we can define a percent improvement in peroxide stability, $$\% \text{ improvement}=[(P_t-P_o)/P_o]\times 100\%$$

where $P_t$=percentage of peroxide retained after the incubation period in the system with silane quaternary ammonium compound, and $P_o$=percentage of peroxide retained after the incubation period in the system without silane quaternary ammonium compound.

It was found that % improvement of stability correlated well with the mole ratio of silane quaternary ammonium compound to anionic surfactant. Referring to FIG. 1, the plotted data suggests that there is a minimum in the degree of improvement around a mole ratio of 0.40 ($4.0\times10^{-1}$).

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A peroxide-containing cleaning composition, comprising:

hydrogen peroxide in the amount of about 0.2 wt. % to 6 wt. % based on the total weight of the composition;

an alkali metal salt in amounts sufficient to maintain a pH of between 8 and 10 wherein said alkali metal salt is selected from the group consisting of sodium bicarbonate, potassium bicarbonate, and combinations thereof;

a combination consisting essentially of a nonionic surfactant which is a $C_{12}$-$C_{15}$ ethoxylated fatty alcohol in an amount of about 3.0 to 7.5 wt. % of said composition;

an amphoteric surfactant selected from the group consisting of Lauryl amine oxide, Decyl amine oxide, and combinations thereof in an amount of about 3.0 to 7.5 wt. % of said composition; and an anionic surfactant which is an alkyl ethoxy sulfate in an amount of about 3.0 to 7.5 wt. % of said composition;

a silane quaternary ammonium compound which is octadecylaminodimethyltrimethoxysilylpropvl ammonium chloride in an amount of about 0.1 to 5.0 wt. % of said composition, said combination enhances the stability of said hydrogen peroxide; and an aqueous diluent, wherein the total amount of surfactants in the peroxide-containing cleaning composition is up to about 15 wt. % based on the total weight of the composition.

2. The composition of claim 1 wherein the amount of the alkali metal salt is up to about 10 wt % based on the total weight of the composition.

3. The composition of claim 2 wherein the amount of the alkali metal salt is in the range of from about 0.1 wt % to 2.5 wt % based on the total weight of the composition.

4. The composition of claim 1, wherein said composition comprises a C1-C4 alcohol as a solvent for the silane quaternary ammonium compound, wherein said solvent is present in an amount of about 10 wt. % to 50 wt. % of the silane quaternary ammonium compound.

5. The composition of claim 4, wherein said C1-C4 alcohol is methanol.

* * * * *